United States Patent [19]

Alexandrovich et al.

[11] Patent Number: 4,547,449

[45] Date of Patent: Oct. 15, 1985

[54] LIQUID ELECTROGRAPHIC DEVELOPERS CONTAINING QUATERNARY AMMONIUM CHARGE-CONTROL POLYMERS HAVING ACIDIC MONOMERS

[75] Inventors: Peter S. Alexandrovich; Louis J. Sorriero, both of Rochester; Chandra Sreekumar, Penfield, all of N.Y.

[73] Assignee: Eastman Kodak Company, Rochester, N.Y.

[21] Appl. No.: 691,799

[22] Filed: Jan. 16, 1985

Related U.S. Application Data

[63] Continuation of Ser. No. 465,747, Feb. 11, 1983, abandoned.

[51] Int. Cl.[4] ..... G03G 9/12

[52] U.S. Cl. ..... 430/115; 430/112; 430/116

[58] Field of Search ..... 430/112, 115, 116

[56] References Cited

U.S. PATENT DOCUMENTS

| | | | |
|---|---|---|---|
| 3,849,165 | 11/1974 | Stahly et al. | 430/119 |
| 3,977,983 | 8/1976 | Tsuneda | 430/115 |
| 4,170,563 | 10/1979 | Merrill et al. | 430/115 |
| 4,229,513 | 10/1980 | Merrill et al. | 430/115 |
| 4,252,921 | 2/1981 | Merrill et al. | 525/437 |
| 4,273,849 | 6/1981 | Merrill et al. | 430/119 |

*Primary Examiner*—Mary F. Downey

*Attorney, Agent, or Firm*—David F. Janci

[57] ABSTRACT

Liquid electrographic developers are disclosed comprising an electrically insulating liquid carrier, toner, a charge-control agent and a charging agent. The charge-control agent is a carrier-soluble, addition copolymer of a quaternary ammonium salt monomer, a monomer having —COOH, —$SO_3H$ or —$PO_3HR$ acidic function wherein R is hydrogen or alkyl, and a solubilizing monomer. The charging agent is a carrier-soluble, addition polar copolymer. The disclosed developers exhibit improved replenishability as evidenced by reduced buildup of charge in the developers during the course of use and repeated replenishment.

10 Claims, No Drawings

LIQUID ELECTROGRAPHIC DEVELOPERS CONTAINING QUATERNARY AMMONIUM CHARGE-CONTROL POLYMERS HAVING ACIDIC MONOMERS

This is a continuation of application Ser. No. 465,747, filed Feb. 11, 1983, now abandoned.

The present invention relates to a liquid electrographic developer composition comprising an electrically insulating carrier liquid, a toner dispersed in the carrier, a quaternary ammonium polymer to control the electrical charge on the pigment, and a polar copolymer to impart charge to the toner dispersion.

In the art of electrography, charge images are formed on a substrate and thereafter rendered visible by contact with an electrographic developer composition. These compositions are formulated in dry or liquid form, each presenting its own unique requirements and advantages.

Liquid electrographic developers are a dispersion of toner particles, usually of a pigment and a binder resin, in an electrically insulating carrier liquid such as a volatile hydrocarbon fraction. The binder resin serves to bind the pigment to the copy paper on which the latent electrostatic image is developed. The developer can also contain a stabilizer additive to maintain a stable dispersion of the toner particles. Liquid developers also often contain a charge-control agent to maintain a constant charge level.

A particularly useful liquid developer is disclosed in U.S. Pat. No. 4,273,849 issued June 16, 1981, to S. H. Merrill et al. This developer comprises an electrically insulating carrier liquid having stably dispersed therein (1) toner particles, and having dissolved therein (2) a copolymer of a quaternary ammonium salt monomer and a solubilizing monomer, and (3) a copolymer of an addition polar monomer and a solubilizing monomer, the amounts of solubilizing monomer units in each copolymer being sufficient to make the copolymer soluble in the carrier liquid alone.

The aforementioned liquid developers of U.S. Pat. No. 4,273,849 have certain drawbacks, however, relating to the stability of their charge as they are used through a number of copy sequences. In particular, the charge of the developer per unit of mass of dispersed toner increases, indicating that the quaternary ammonium charge-control copolymer deposits on an electrostatic image at a lower rate than the toner. This uneven depletion rate and consequential increase in charge per unit mass in the developer presents difficulty in developer replenishment and causes nonuniform image density from copy to copy.

In accordance with the present invention, the charge of the developer per unit mass of toner is stabilized so that, after a period of use, the buildup of charge per unit of mass is significantly reduced. Such stability is achieved when the quaternary ammonium salt charge-control polymer in the above-described developer composition contains an insolubilizing monomer having an acidic function selected from the group consisting of —COOH, —$SO_3H$ and —$PO_3HR$ wherein R is hydrogen or alkyl.

The present invention provides, therefore, electrographic liquid developer compositions, and processes for their use, comprising an electrically insulating carrier liquid having dispersed toner particles and (1) a charge-control agent comprising a carrier-soluble addition copolymer of a quaternary ammonium salt monomer, a solubilizing monomer and an insolubilizing monomer having an acidic function selected from the group consisting of —COOH, —$SO_3H$ and $PO_3HR$ wherein R is hydrogen or alkyl, and (2) a carrier-soluble charging addition copolymer comprising a polar monomer and a solubilizing monomer. When R is alkyl in the —$PO_3HR$ group, it is preferably 1–10 carbon alkyl such as methyl, propyl, amyl or hexyl. More preferably, alkyl is 1–4 carbon alkyl.

In a preferred embodiment of the invention, the charge of the developer per unit mass is further stabilized against change when the toner contains a neutral or basic pigment.

The present invention constitutes an improvement of the prior-art liquid developers disclosed in the U.S. Pat. Nos. 4,273,849 and 4,252,921, the disclosures of which are incorporated herewith by reference. These developers comprise a carrier liquid, dispersed toner particles, a carrier-soluble charge-control addition polymer and a carrier-soluble polar addition polymer to stabilize the dispersion of toner. The improvement is provided by incorporating the acidic monomer defined above into the charge-control polymer.

The liquid carrier employed in our developer has a low dielectric constant and a high electrical resistance such that it will not disturb or destroy the electrostatic charge pattern being developed. Carrier liquids should have a dielectric constant of less than about 3, have a volume resistivity greater than about $10^{10}$ ohm-cm and be chemically stable. Suitable carrier liquids include halogenated hydrocarbon solvents such as trichlorotrifluoroethane; hydrocarbon solvents are useful, such as isoparaffinic hydrocarbons and cyclohydrocarbons such as cyclohexane. Preferably, the liquid carrier is a combination of two different electrically insulating liquids as disclosed in copending U.S. patent application Ser. No. 249,330 entitled REPLENISHABLE LIQUID ELECTROGRAPHIC DEVELOPERS CONTAINING WAX, filed Mar. 31, 1981, in the names of P. A. Alexandrovich et al, the disclosure of which is incorporated by reference.

Toner is dispersed in the carrier and serves as the marking particle constituent which is attracted to an electrostatic charge image on an element being developed. The toner comprises a colorant and a binder polymer, if necessary, for adhesion of the colorant to the image-bearing element. Colorants can be selected from one or more of a variety of dyes and pigments. Carbon black is a preferred colorant, but virtually any of the compounds in the "Colour Index", Second Edition, 1956, Volumes I and II, may, in principle, be used.

Preferred toners comprise neutral or basic pigments such as neutral or basic carbon black pigments. The neutrality or basicity of a pigment is determined as the pH of the pigment by the ASTM D 1512-60(76) method, details of which are reported in the "Analysis of Carbon Black" by B. Schubert et al, *Encyclopedia of Industrial Chemical Analysis,* Volume B (reprint pages 51–52, pH), John Wiley and Sons, Inc.. Neutral or basic pigments according to this method exhibit a pH of 7 and higher.

Binder polymers which can be employed with the toner particles, if desired, include a variety of materials such as halogenated polyolefins, addition polymers such as acrylic polymers and condensation polymers. Preferably, such polymers are polyesterionomers such as disclosed in U.S. Pat. No. 4,252,921 to D. Santilli et al.

The developer of the present invention includes, as a charge-control agent, a carrier-soluble addition quaternary ammonium salt polymer. "Carrier-soluble" refers to its ability to dissolve in the electrically insulating carrier, in the absence of the toner constituents, at the concentration level at which it is employed in the developer. The monomer constituents of the polymer include at least the following: a quaternary ammonium salt monomer, a solubilizing monomer, and a monomer having an acidic function selected from the group consisting of —COOH, —$SO_3H$ and —$PO_3HR$.

Examples of suitable quaternary ammonium salt monomers include:

methacryloyloxyethyltrimethylammonium p-toluene sulfonate;

dimethyloctadecylvinylbenzylammonium chloride;

2-vinyl-N-methylpyridinium methyl sulfate;

N-methyl-N-methacryloyloxyethylpiperidinium bromide;

N-methacryloyloxyethylpyridinium nitrate.

Representative solubilizing monomers include the following: alkylstyrenes and alkoxystyrenes having about 3 to about 10 carbon atoms in the alkyl group; alkyl acrylates and methacrylates having about 8 to about 22 carbon atoms in the alkyl group; vinyl alkyl ethers having about 8 to about 22 carbon atoms in the alkyl group; and vinyl esters of alkanoic acids having about 6 to about 22 carbon atoms in the alkyl group.

Specific solubilizing monomers which can be so used include: t-butylstyrene, 4-pentylstyrene, 4-hexylstyrene, 4-octylstyrene, p-amyloxystyrene, lauryl acrylate, lauryl methacrylate, hexadecyl methacrylate, octadecyl methacrylate, eicosyl acrylate, docosyl methacrylate, vinyl caprate, vinyl laurate, vinyl palmitate, vinyl stearate, vinyl eicosate and vinyl docosate.

Suitable insolubilizing monomers having an acidic function include addition polymerizable polymers such as olefinic and acrylic monomers having the requisite acidic function. Representative acidic monomers include:

Monomers containing —COOH:

acrylic acid methacrylic acid vinyyl benzoic acid styryl acetic acid

Monomers containing —$SO_3H$:

sulfoethyl methacrylamide sulfoethyl methacrylate styrene sulfonic acid

Monomers containing —$PO_3HR$:

vinylbenzylethylphosphate vinylbenzylphosphosphonic acid vinylphosphonic acid vinylethylphosphonate In addition to the quaternary ammonium, solubilizing and acidic monomers, the charge control polymer set forth above can include additional other monomers such as to adjust the degree of solubility of the polymer in the carrier, as well as to provide other desirable properties.

Quaternary ammonium salt polymers useful in the liquid developers of this invention typically have an inherent viscosity in the range from about 0.1 to about 0.8. The determination is made at a concentraton of 0.25 gram of polymer in 100 ml of chloroform at a temperature of 25° C. The resultant polymers contain recurring units derived from one or more solubilizing monomers, from one or more quaternary ammonium salt monomers and from one or more insolubilizing acidic monomers. A typical quaternary ammonium salt copolymer used in the liquid developers of the invention contains from about 85 to about 96 mole weight percent of solubilizing monomer units, from about 10 to about 2 mole weight percent acidic insolubilizing monomer units, and from about 5 to about 1 mole weight percent of quaternary ammonium salt monomer units.

The solubility of the quaternary ammonium salt copolymer in the carrier liquid can be controlled by adjusting the amount of solubilizing and insolubilizing acidic monomers which are used. If the solubilizing monomer has a very long alkyl group, rendering a polymer containing it very soluble in hydrocarbon carrier liquids, the insolubilizing monomer may have a relatively short alkyl group. On the other hand, a relatively short alkyl group on the solubilizing monomer requires a somewhat longer alkly group on the insolubilizing monomer if one is used.

The relative amount of quaternary ammonium salt monomer can be varied to provide polymers having different charge properties when incorporated into a liquid developer.

The developer of the present invention also contains, as a charging agent, a carrier-soluble polar addition copolymer of the type disclosed in U.S. Pat. Nos. 4,273,849 by Merrill et al issued June 16, 1981, and 3,849,165 by Stahly et al issued Nov. 19, 1974. As above, "carrier-soluble" refers to the ability of the charging copolymer to dissolve in the liquid carrier, in the absence of the toner constituents, at the concentration level which is employed in the developer.

The soluble polar copolymer is an addition copolymer of a polar monomer and at least one solubilizing monomer. The amount of polar monomer is at least about $1.5\times10^{-4}$ moles/gm of copolymer.

Monomers for addition copolymerizing with the polar monomer to obtain a soluble polar copolymer are the solubilizing monomers previously described and, if desired, insolubilizing monomers such as styrene, vinyl toluene, ethyl acrylate, methyl acrylate, butyl acrylate, ethyl methacrylate, propyl methacrylate, butyl methacrylate, vinyl acetate, vinyl propionate and vinyl butyrate, as described by Stahly et al, U.S. Pat. No. 3,849,165. The relative amounts of the comonomers are selected to produce a polar addition copolymer of the desired solubility, as described above with respect to the quaternary ammonium salt copolymers.

Suitable polar monomers include sulfoalkyl acrylates and methacrylates, metal salts of sulfoalkyl acrylates and methacrylates, and amine salts of sulfoalkyl acrylates and methacrylates. Preferably, the sulfoalkyl groups contain from 1 to about 4 carbon atoms. Also suitable are metal salts and amine salts of acrylic and methacrylic acids, and of vinylbenzoic acid, vinylphenylacetic acid, 9(10)-acrylamidostearic acid, monoalkylphthalic acid, and styrenesulfonic acid, the metals of said salts being from Groups I, IIa, IIb and VIII of the periodic table, and mixtures thereof.

Preferred polar monomers are acrylic monomers. In this sense, the term "acrylic" broadly includes methacrylic, and salts and esters of such acrylic, acids.

Specific examples of such acrylic polar monomers include sulfoethyl methacrylate; sulfoethyl acrylate; sulfopropyl methacrylate; sulfobutyl methacrylate; sulfoethyl methacrylate, sodium salt; sulfoethyl methacrylate, partial sodium salt; sulfopropyl methacrylate, sodium salt; sulfobutyl methacrylate, potassium salt; sulfoethyl methacrylate, lithium salt; sulfoethyl methacrylate, copper salt; sulfopropyl methacrylate, dimethylammonium salt; sulfoethyl methacrylate diethylammonium salt; sulfomethyl acrylate, dimethylammonium salt; sodium methacrylate; sodium acrylate; lithium methacrylate; potassium acrylate; barium methacrylate; zinc methacrylate; cobalt methacrylate; ferrous acrylate; magnesium methacrylate; zinc acrylate; and mixtures thereof.

The liquid electrographic developers of this invention contain from about 0.01 percent to about 5 percent by weight of soluble polar copolymer, from about 0.01 percent to about 5 percent by weight of quaternary ammonium salt copolymer, and from 0.01 percent to about 5 percent by weight of toner. Preferred developers contain from about 0.02 percent to about 0.5 percent by weight of the soluble acrylic polar copolymer, from about 0.02 percent to about 0.5 percent by weight quaternary ammonium salt copolymer, and from about 0.02 percent to about 0.5 percent by weight toner.

In the following examples, developers of the present invention are evaluated for replenishability, R or charge distributions. Replenishability R is defined for the purpose of the present invention as the ratio of initial charge/mass to final charge/mass after a ½ liter reservoir of the developer has been employed to form electrographic images and replenished. The extent of imaging and replenishment was predetermined so as to use and replenish three times the number of marking particles in the original developer. (For example, if the developer contains 0.2 gram toner, 0.6 gram is developed and replenished.) The replenisher employed was a 5× concentrate of the original developer. The charge before and after in coulombs was measured with a Keithly Instruments Capacitance Bridge (available from Tettex Instruments, Inc., Pennsylvania). The charge measured is divided by the toner weight in kilograms to give charge per mass in coulombs per kilogram tone.

The following developer components were employed in an Isopar G ®-Solvesso 100 ® liquid carrier system with a pigment concentration of 0.7 gram per liter developer. (Solvesso 100 ® is an alkylated aromatic liquid and Isopar G ® is an isoparaffinic hydrocarbon liquid.) The Solvesso 100 ® concentration was approximately 21 grams per liter of developer.

| Developer | Component | Type | Parts by Weight |
|---|---|---|---|
| A | (1) toner | | |
| | pigment | Acidic Raven 1255 ® carbon black | 1 |
| | binder | poly[neopentyl-4-methylcyclohexene-1,2-dicarboxylate-co-terephthalate-co-5-(N—potassio-p-toluene sulphonamidosulphonyl)isophthalate] | 1.2 |
| | (2) addition polar copolymer charging agent | poly(t-butyl styrene-co-lithium methacrylate) 97/3 | 1 |
| | (3) quaternary ammonium charge-control agent | poly(t-butyl styrene-co-methacrylic acid co-methacryloyloxyethyltrimethyl ammonium-p-toluene sulfonate | 0.2 |
| B | (1) toner | | |
| | pigment | Acidic Raven 1255 ® carbon black | 1 |
| | binder | poly[neopentyl-4-methylcyclohexene-1,2-dicarboxylate-co-terephthalate-co-5-(N—potassio-p-toluene sulphonamidosulphonyl)isophthalate] | 1.2 |
| | (2) addition polar copolymer charging agent | poly(t-butyl styrene-co-lauryl methacrylate-co-lithium methacrylate-co-methacrylic acid) 60/36/36/0.4 | 1.5 |
| | (3) quaternary ammonium charge-control agent | poly(t-butyl styrene-co-methacrylic acid-co-methacryloyloxyethyl trimethyl ammonium p-toluene sulfonate) | .3 and .2 |
| C | (1) toner | | |
| | pigment | Regal 300 ® carbon black | 1 |
| | binder | poly[neopentyl-4-methylcyclohexene-1,2-dicarboxylate-co-terephthalate-co-5-(N—potassio-p-toluene sulphonamidosulphonyl)isophthalate] | 1.2 |
| | (2) addition polar copolymer charging agent | poly(t-butyl styrene-co-lauryl methacrylate-co-lithium methacrylate-co-methacrylic acid) 60/36/36/0.4 | 1.5 |
| | (3) quaternary ammonium charge-control agent | poly(t-butyl styrene-co-methacrylic acid-co-methacryloyloxyethyltrimethyl ammonium-p-toluene sulfonate) | .3 and .2 |

Each of the developers also contained 0.5 part plasticizer, 0.25 part wax and 0.125 part dispersing agent for the wax.

EXAMPLES 1–4

In this example, replenishability R of control liquid developers containing quaternary ammonium charge-control polymers as described by Merill, U.S. Pat. No. 4,273,849, column 5, was compared with R for liquid developers within the scope of the invention.

The developer of the invention corresponded to Developer A above. The charge-control polymer employed in the control developer was either (a) an addition terpolymer of a solubilizing monomer, an insolubilizing monomer which contained no acidic groups and a quaternary ammonium monomer or (b) an addition copolymer of a monomer and a quaternary ammonium polymer. In all other respects, the control developers and developers of the invention were identical.

The results in terms of R values are reported in Table 1.

TABLE 1

| Example | Charge Control Polymer: Solubilizing Monomer (mole percent) | Insolubilizing Monomer (mole percent) | Quaternary Ammonium Copolymer (mole percent) | R |
|---|---|---|---|---|
| Control | lauryl methacrylate (34) | vinyl toluene (64) | methacryloyloxy-ethyltrimethyl ammonium-p-toluene sulfonate (2) | .62 |
| Control | t-butylstyrene (98) | — | same (2) | .75 |
| Control | t-butylstyrene (98.5) | — | same (1.5) | .77 |
| 1 | t-butylstyrene (95.5) | methacrylic acid (2.5) | same (2) | .82 |
| 2 | t-butylstyrene (93) | methacrylic acid (5) | same (2) | .82 |
| 3 | t-butylstyrene (92) | methacrylic acid (5) | same (3) | .83 |
| 4 | t-butylstyrene (87) | methacrylic acid (10) | same (3) | .86 |

These results indicate that, when the insolubilizing monomer is acidic, developer replenishability, R, is improved relative to charge-control polymers containing either nonacidic insolubilizing monomer or no insolubilizing monomer

EXAMPLES 5-7

These examples illustrate that replenishability, R, is further enhanced by the use of nonacidic colorants.

The procedure of Examples 1-4 was repeated employing developer A with either Raven 1255 ® carbon black, which was neutralized by washing, or neutral Regal 300 ® carbon black. The concentration of addition polar copolymer and quaternary ammonium charge-control polymer was also varied as indicated Replenishability values, R, are reported in Table 2.

TABLE 2

| Example | Colorant | Addition Polar Copolymer Concentration (parts, by weight) | Quaternary Ammonium Polymer Concentration (parts, by weight) | R |
|---|---|---|---|---|
| 5 | neutral Raven 1255 ® carbon black | 1 | .2 | 0.84 |
| 6 | neutral Regal 300 ® carbon black | 0.8 | .1 | 0.91 |
| 7 | neutral Regal 300 ® carbon black | 0.8 | .2 | 0.98 |

The R values for Examples 5-7 are to be compared with the R value for the developer in Example 2, an otherwise identical developer. The results indicate that basic or neutral pigments improve the replenishability in the developers of the present invention compared with acidic pigments.

EXAMPLE 8

Developers B and C, when subjected to the procedure of Examples 1-7, are expected to show increased replenishability, R, compared with controls analagous to those above.

The present invention specifies that the charge-control polymer contain monomers with a quaternary ammonium group. Other 'onium groups such as sulfonium or phosphonium are expected also to result in comparable developers with enhanced replenishability.

Although the invention has been described in considerable detail with particular reference to certain preferred embodiments thereof, variations and modifications can be effected within the spirit and scope of the invention.

We claim:

1. A liquid electrographic developer comprosition comprising an electrically insulating liquid carrier containing (a) dispersed toner particles, (b) a charge-control agent comprising an addition copolymer of a quaternary ammonium salt monomer, a solubilizing monomer and an acidic insolubilizing monomer having an acidic function selected from the group consisting of —COOH, —$SO_3H$ and —$PO_3HR$ wherein R is hydrogen or alkyl, and the amount of solubilizing monomer is sufficient to render said charge-control agent soluble in said liquid carrier, and (c) a charging addition copolymer comprising a polar monomer and a solubilizing monomer which may be the same as or different from the solubilizing monomer in said charge-control agent, and is present in an amount sufficient to render said charging addition copolymer soluble in said carrier liquid.

2. A developer as in claim 1 wherein said acidic insolubilizing monomer is selected from the group consisting of acrylic acid, methacrylic acid, vinyl benzoic acid, styrene acetic acid, sulfoethyl methacrylamide, sulfoethyl methacrylate, styrene sulfonic acid, vinylbenzylethylphosphate, vinylbenzylphosphosphonic acid, vinylphosphonic acid and vinylethylphosphonate.

3. A developer as in claim 2 wherein said solubilizing monomer in (b) and (c) are independently selected from the group consisting of t-butylstyrene, 4-pentylstyrene, 4-hexylstyrene, 4-octylstyrene, p-amyloxystyrene, lauryl acrylate, lauryl methacrylate, hexadecyl methacrylate, octadecyl methacrylate, eicosyl acrylate, docosyl methacrylate, vinyl caprate, vinyl laurate, vinyl palmitate, vinyl stearate, vinyl eicosate and vinyl docosate, said quaternary ammonium salt monomer is selected from the group consisting of methacryloyloxyethyltrimethylammonium p-toluene sulfonate, dimethyloctadecylvinylbenzylammonium chloride, 2-vinyl-N-methylpyridinium methyl sulfate, N-methyl-N-methacryloyloxyethylpiperidinium bromide, and N-methacryloyloxyethylpyridinium nitrate, and said polar monomer is selected from the group consisting of sulfoethyl methacrylate, sulfoethyl acrylate; sulfopropyl methacrylate; sulfobutyl methacrylate; sulfoethyl methacrylate, sodium salt; sulfoethyl methacrylate, partial sodium salt; sulfopropyl methacrylate, sodium salt; sulfobutyl methacrylate, potassium salt; sulfoethyl methacrylate, lithium salt; sulfoethyl methacrylate, copper salt; sulfopropyl methacrylate, dimethylammonium salt; sulfoethyl methacrylate diethylammonium salt; sulfomethyl acrylate; dimethylammonium salt; sodium methacrylate; sodium acrylate; lithium methacrylate; potassium acrylate; barium methacrylate; zinc methacrylate; cobalt methacrylate; ferrous acrylate; magnesium methacrylate; and zinc acrylate.

4. A developer as in claim 1 wherein the concentrations of said toner of said charge-control agent, and of said charging agent, are each about 0.01 to about 5 percent, by weight of total developer.

5. A developer as in claim 4 wherein said concentrations are about 0.02 to about 0.5 percent.

6. A developer as in claim 1 wherein said toner comprises a neutral pH or basic pH colorant.

7. A developer as in claim 6 wherein said toner further comprises a polyesterionomer as a binder for said colorant.

8. A developer as in claim 6 wherein said charge-control agent is poly(t-butyl styrene-co-methacrylic acid-co-methacryloyloxyethyltrimethylammonium-p-toluene sulfonate) and said charging agent is poly(t-butyl styrene-co-lithium methacrylate) or poly(t-butyl styrene-co-lauryl methacrylate-co-lithium methacrylate-co-methacrylic acid).

9. A developer as in claim 1, 2, 3, 4, 5, 6, 7 or 8 comprising, in addition, a second electrically insulating carrier liquid.

10. A developer as in claim 9 wherein said charging agent is poly(t-butyl styrene-co-lithium methacrylate) and said electrically insulating carriers are an isoparaffinic hydrocarbon liquid and an alkylated aromatic liquid.

* * * * *